United States Patent [19]

Shishido

[11] Patent Number: 4,595,200

[45] **Date of Patent: * Jun. 17, 1986**

[54] SOUND EMITTING BALL

[75] Inventor: Hideomi Shishido, Hiroshima, Japan

[73] Assignee: Molten Corporation, Hiroshima, Japan

[ * ] Notice: The portion of the term of this patent subsequent to Mar. 25, 2003 has been disclaimed.

[21] Appl. No.: 621,632

[22] Filed: Jun. 18, 1984

[30] Foreign Application Priority Data

| | | | |
|---|---|---|---|
| Jun. 21, 1983 | [JP] | Japan | 58-112047 |
| Sep. 22, 1983 | [JP] | Japan | 58-147405[U] |
| Feb. 28, 1984 | [JP] | Japan | 59-28716[U] |
| Feb. 28, 1984 | [JP] | Japan | 59-28718[U] |
| Mar. 21, 1984 | [JP] | Japan | 59-40840[U] |

[51] Int. Cl.[4] ..... A63B 41/00

[52] U.S. Cl. ..... 273/58 G; 273/65 EF

[58] Field of Search ..... 273/58 E, 58 G, 65 EF, 273/213

[56] References Cited

U.S. PATENT DOCUMENTS

| | | | |
|---|---|---|---|
| 3,782,730 | 1/1974 | Horchler | 273/213 |
| 4,440,400 | 4/1984 | Neuberger | 273/58 G |

FOREIGN PATENT DOCUMENTS

| | | |
|---|---|---|
| 3081 | 2/1965 | Japan . |
| 23401 | 10/1968 | Japan . |

OTHER PUBLICATIONS

"High-Resiliency PUR Foam Meets a Special Molding Requirement", Modern Plastics International, p. 26, (Dec. 1982).

*Primary Examiner*—Richard C. Pinkham
*Assistant Examiner*—Vincent A. Mosconi
*Attorney, Agent, or Firm*—Armstrong, Nikaido Marmelstein & Kubovcik

[57] ABSTRACT

A sound emitting ball has (a) a ball having an airtight bladder with an air injection valve, (b) a housing provided within the ball on the opposite side of the bladder with respect to the valve without interferring with the airtightness of the bladder, (c) a cover for concealing the housing, (d) a detector for detecting an application of external force to the ball, (e) a sound generator for generating a sound signal according to the signal from the detector, (f) a speaker for emitting sound according to the sound signal from the sound generator, and (g) a battery power source. The detector, sound generator, speaker, and battery power source are accommodated in the housing and the sum of the weights of the housing, cover, detector, sound generator, speaker, and battery power source are adjusted to a weight which does not substantially interfere with the impact resilience of the bladder and is substantially the same as the weight of the valve.

10 Claims, 25 Drawing Figures

SOUND EMITTING BALL

BACKGROUND OF THE INVENTION

The present invention relates to a sound emitting ball for various sports and games using a relatively large ball such as a handball, a soccer ball or a dodge ball.

Balls having a sound emitting function have been known. One of such balls is a ball within which a bell is accommodated. The ball emits sound only when the ball is kicked or rolled. However, since the sensitivity of the bell cannot be controlled according to the movement of the ball, the ball cannot emit a regular sound, which weakens a player's interest. Further, the ball has a drawback in feeling because the bell accommodated in the ball is rolled here and there.

Another ball which emits sound by means of an electrically emitting sound circuit and a battery is proposed in Japanese Examined Patent Publication (KOKOKU) No. 23401/1968. However, such a ball cannot be realized because the electric circuit employed requires much electric power demand which cannot be supplied from any battery, and the weight is to heavy too achieve smooth movement of the ball.

An object of the present invention is to provide a sound emitting ball comprising means for detecting an external impact force, means for generating a signal to drive a sound emitting means and a power supply which are assembled into a unit which is detachable. The weight of the unit does not exert substantial interference to the movement of the ball and the electric power demand is extremely lowered.

Another object of the present invention is to provide a sound emitting ball having a unit for electronically emitting sound in the surface area, but not within an inside space of the ball.

SUMMARY OF THE INVENTION

According to the present invention, there is provided a sound emitting ball, comprising (a) a ball having an airtight bladder for giving impact resilience to the ball in which compressed air is charged through an air injection valve, (b) a concave housing provided with the ball on the opposite portion of the valve and being in contact with surface of the bladder while keeping the airtightness of the bladder, (c) means for detecting an external force applied to the ball, (d) means consisting of an integrated circuit for generating a sound signal according to the signal from the detecting means, (e) means for emitting sound according to the sound signal from the means (d), and (f) a battery power source for driving the above means; said means (c), (d), (e), and (f) being accommodated in the housing, and the sum of the weights of the housing (b) and the means (c), (d), (e) and (f) being adjusted to the weight which does not substantially interfere the impact resilience of the ball and is substantially the same as the weight of the valve.

DETAILED DESCRIPTION

Figure 1:
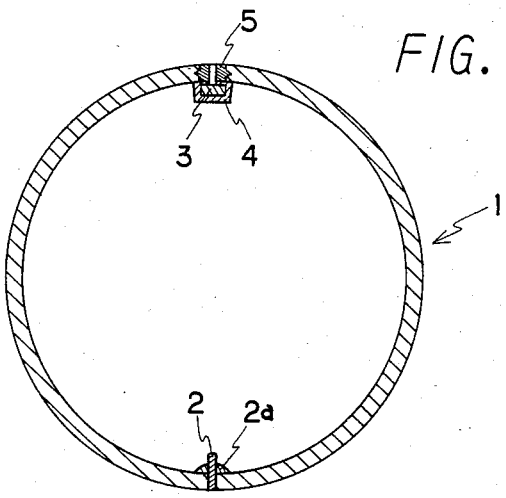
FIG. 1 shows a sectional view of an embodiment of the present invention.

FIG. 1 shows a sectional view of a sound emitting ball 1 having a suitable size and a shape for a handball, a soccer ball, a dodge ball, and the like. The ball comprises a bladder having an air injection valve 2. On the opposite side of the valve 2, there is provided a circuit unit 3 which is accommodated in a concave housing 4 and is secured to the housing 4 with a cover 5 by pressing. The total weight of the unit 3 (including a battery), the housing 4 and the cover 5 is almost the same as the weight of the valve part 2, so that the centre of the ball is coincident with the centre of gravity thereof.

According to the present invention, the weight of the unit 3 can be reduced to about 20 to about 30 g by using compact elements such as an integrated circuit and a piezoelectric speaker. On the other hand, since the weight of the valve 2 is usually about 8 g, a balancer 2*a* is attached to the valve 2. Such an increased weight, i.e. about 32 to about 52 g, does not give substantial influence to the ball movement, because a weight of the ball such as a soccer ball is about 500 to about 700 g and the increased weight is about one-tenth the ball weight or less.

Figure 3:
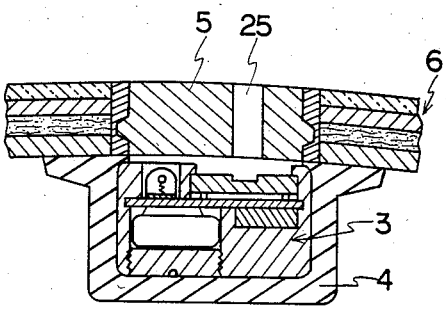
FIG. 3 shows a sectional view of the embodiment shown in FIG. 2 after fixing.
Figure 2:
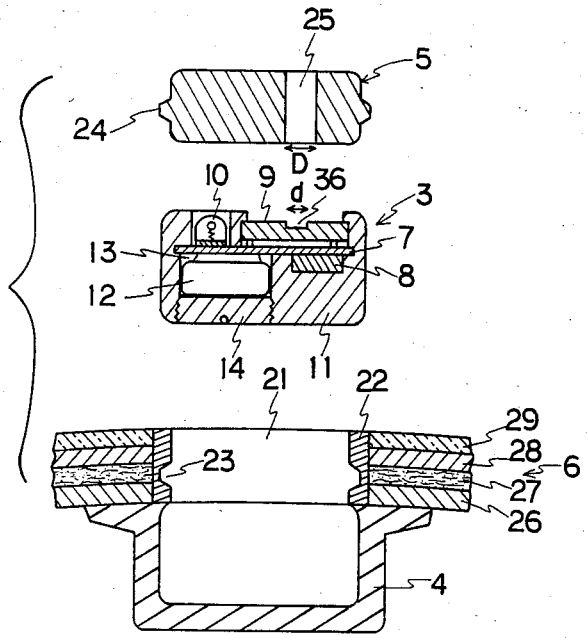
FIG. 2 shows a sectional view of each member used in the present invention before fixing.
Figure 4:
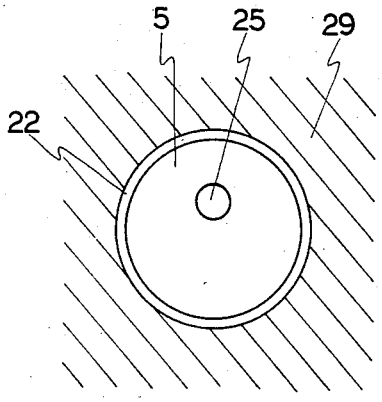
FIG. 4 shows a front view of the cover shown in FIG. 3.

An embodiment of the circuit unit 3 is shown in FIGS. 2 to 4. The circuit unit 3 is accommodated in the housing which is provided with a body 6 of the ball 1 and fixed by means of the cover 5 made of elastic material such as a rubber. The unit 3 comprises a circuit board 7, a circuit portion 8 including circuits of a waveform fixing circuit and an oscillating circuit, a piezoelectric speaker 9 operable as the sound emitting means, and an impact sensor 10 operable as the impact detecting means. Those parts are integrally molded with a resin 11. The unit 3 also has a battery case 13 in which a battery 12 is accommodated. The battery case 13 is closed with screws 14 made of a resin. The circuit portion 8 is fixed to the inner surface side (under surface side in FIG. 2) of the boad 7, while the piezoelectric speaker 9 and the sensor 10 are fixed to the outer surface side (upper surface side in FIG. 2) of the boad 7. Alternatively, the sensor 10 may be fixed to the inner surface side of the boad 7. The piezoelectric speaker 9 has a sound emitting portion 36. As the sound emitting means, an electromagnetic speaker or a microspeaker may also be used instead of the piezoelectric speaker 9. Among them, since the piezoelectric speaker and the electromagnetic speaker require small electric power demand, e.g. about 1 mA and about several miliamperes respectively, they are particularly suitable for a speaker drived by the battery. One electrode of the battery 12 is in contact with the inner surface of the boad 7, while the other electrode of the battery 12 is in contact with the boad 7 at its side surface.

The cover 5 is made of an elastic material such as a rubber and is pushed into an opening 21 provided in the body 6 of the ball 1. For improving the surface of the cover in appearance and touchness, the outer surface area may be made of the same material as that of the ball surface layer. On the inner side wall of the opening 21 a reinforcing member 22 made of a rubber, and the like is provided. The reinforcing member 22 has an annular groove 23 on its inner side. The cover 5 has an annular projection 24 around its side and the annular projection 24 can be fitted to the groove 23 so that the cover 5 is tightly fixed to the body 6 of the ball 1. The cover 5 also has a sound emitting bore 25 at a position corresponding to the sound emitting portion 36. The size of the sound emitting bore 25 is larger than that of the sound emitting portion 36. Namely, it is required that the diameter d of the portion 36 is the same of larger than the diameter D of the bore 25. In such a case, the sound emitted from the portion 36 is transmitted without being absorved by the cover. It is more effective when the bore 25 is tapered off to the portion 36.

The concave housing 4 is formed of a bag of an elastic material and is adhered to an inner surface of a bladder 26. The circuit unit 3 is supported by being clamped with the housing 4.

The ball body 6 comprises the bladder 26 made of an elastic material such as a butyl rubber, a thread layer 27 for restricting a size, reinforcing the ball and giving elastisity to the ball, an intermediate layer 28 made of a highly elastic rubber such as a natural rubber, and a surface layer 29 made of a natural leather, a synthetic leather or a rubber sheet.

Front view of the cover 5 is shown in FIG. 4. The diameter of the cover 5 is preferably designed so that the diameter of the cover 5 is slightly smaller than that of the unit 3. Preferable size of the cover is about 1.0 to about 1.5 cm.

Figures 5A, 5B:
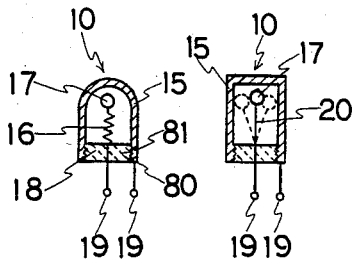
FIG. 5*a*, 5*b*, 5*c* and 5*d* shows sectional views of various impact sensors used in the present invention.

As the impact sensor fixed on the boad 7, a mechanical impact sensor 10 as shown in FIG. 5*a* may be employed. The impact sensor 10 comprises a cylindrical fixed electrode 15 made of an electrically conductive metal such as aluminium or copper, a spherical weight electrode 17 made of an electrically conductive metal such as iron supported by a coil spring 16 within the cylindrical fixed electrode 15, and a fixing member 18 made of an electrical insulator provided between the cylindrical fixed electrode 15 and the coil spring 16. The coil spring 16 is made of an electrically conductive metal, and also serves as a lead wire. The fixing member 18 is made of an electrical insulator such as polytetrafluoroethylene. Around the side of the fixing member 18 a threaded portion 80 is provided and is screwed into a threaded portion 81 provide abound the inner surface of the cylindrical fixed electrode 15. The cylindrical fixed electrode 15 and the coil spring 16 have a respective terminal 19 and is electrically connected to the circuit portion 8 through the boad 7.

The impact sensor 10 can detect an impact force when the spherical weight electrode 17 swings, and then is in contact with the cylindrical fixed electrode 15. Therefore, the sensitivity of the snesor can be controlled by selecting a spring constant of the coil spring 16 and a weight and size of the spherical weight electrode 17. The embodiment shown in FIG. 5*a* is adjusted to detect a strong impact force which is applied to the ball when the ball is kicked or bounds to high.

Another embodiment of the impact sensor is shown in FIG. 5*b*. In the embodiment a spring 20 in a form of line or plate is employed instead of the coil spring 16. In practice such spring 20 is also useble.

Figure 5C:
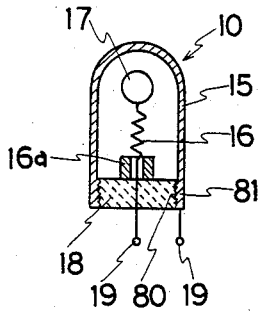
Figure 5D:
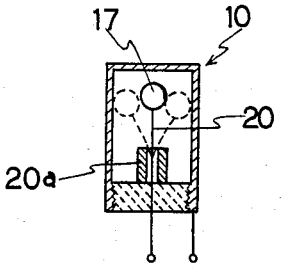

In a certain case, when the impact force is applied, stress is concentrated to the bottom portion of the spring 16, 20 which sometimes causes the spring to be bent or broken by repeated impacts. In order to avoid such troubles the bottom portion of the spring 16, 20 is protected with a cylindrical member 16*a*, 20*a* for restricting the amplitude of the spring 16, 20 as shown in FIGS. 5*c* and 5*d*. The protection member 16*a*, 20*a* is preferably made of an elastic and soft material such as a rubber, a sponge or a soft resin, but may also be made of a hard material such as a metal. By employing the protecting member 16*a*, 20*a*, the stress resulted from the swing or vibration of the spring 16, 20 is shared with the protecting member. Particularly when the protecting member is made of an elastic material, the protecting member serves as a cushion. As a result, the stress is not concentrated to the bottom portion of the spring, which makes the bending and breakage reduced. Instead of the impact sensor, a pressure sensor or a load sensor may be employed.

Figure 6:
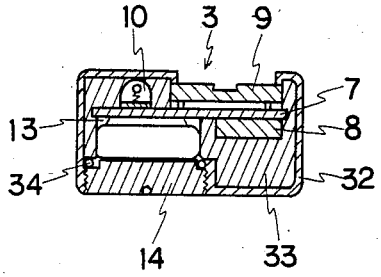
FIG. 6 shows a sectional view of a circuit unit used in the present invention.

Another embodiment of the circuit unit is shown in FIG. 6. This embodiment has a waterproof structure and comprises a sealing case 32 of a metal or a waterproof resin. The boad 7, the circuit portion 8 and the sensor 10 are embeded in the case 32 by filling with a silicone resin 33. The screw 14 is also made of a waterproof resin. A waterproof packing 34 is provided for preventing the penetration of water into the battery case 13. The piezoelectric speaker 9 has also a water proof structure.

Figure 7:
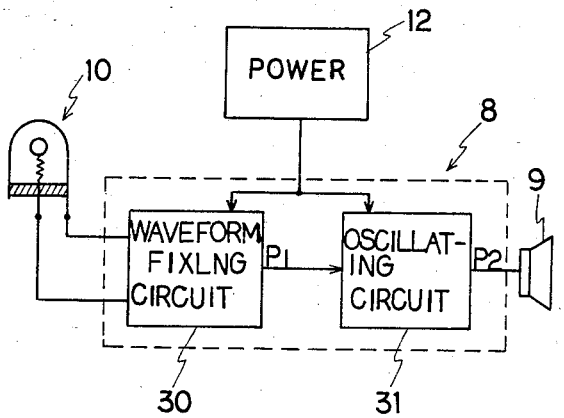
FIG. 7 shows a circuit diagram of an embodiment used in the present invention.
Figure 8:
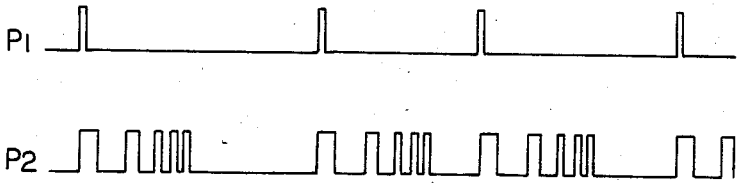
FIG. 8 shows a signal waveform chart obtained in the embodiment according to FIG. 6.

A preferred embodiment of the electric circuit is shown in FIG. 7. The circuit portion 8 comprises a waveform fixing circuit 30 and an oscillating circuit 31. A power is supplied to the circuits from the battery 12. The circuits do not require a power switch because an electrical power demand is quite little when the speaker 9 is in a rest state. As the battery 12, there may be employed a lithium cell, a silver oxide cell, a mercury cell, an alkaline battery, and the like. Those batteries are suitable for the present invention due to their light weight, e.g. about 1 to 3 g, and large capacity. The signal from the sensor 10 is applied to the waveform fixing circuit 30, and then fixed its waveform to give a signal P1 shown in FIG. 8. According to the input signal P1, the oscillating circuit 31 outputs given pulses P2, for example, a pulse train comprising several pulses different in pulse duration and pulse separation. The pulse train may comprise several pulses having the same duration and separation. The pulse train P2 is applied to the piezoelectric speaker 9 to emit an intermittent sound.

As mentioned above, the ball of this embodiment can emit a given intermittent sound only when the ball is kicked and is dropped from high position to ground.

Figure 9:
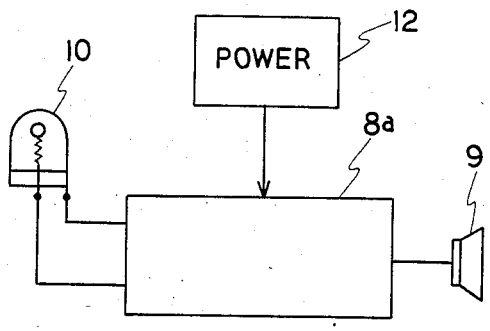
FIG. 9 shows a circuit diagram of another embodiment used in the present invention.

It is possible that the waveform fixing circuit 30 and the oscillating circuit 31 are made into one chip of LSI element, and also that a melody signal generating circuit which generates a melody signal at a given duration, e.g. from several seconds to 10 seconds, is employed instead of the oscillating circuit 31. Further, when an LSI for speach system is employed, it is possible to emit a voice sound such as "once", "twice" and so on corresponding to the impact force applied to the ball. As the melody signal generating circuit and the voice signal generating circuit, there can be used a commercially available melody IC and an LSI for speech system. Since such an IC and LSI require a small power demand, they can be sufficiently driven by a battery. An embodiment of a circuit using the IC or LSI 8*a* is shown in FIG. 9. In case of employing the melody IC as the circuit 8*a*, the melody IC emits a different melody sound by utilizing a counter bult-in the IC at a time when an impact force is detected. In case of employing the LSI for speech system, the LSI can drive the speaker to emit a counting voice sound "once", "twice" and so on by previously writing an information for such voices into ROM. The other parts in FIG. 9 are the same as those in FIG. 7. Optionally the melody IC and the LSI for speech system may be designed so that the circuits are reset when the circuit does not receive a signal from the sensor 10 within a predetermined period from the last input signal. When the period expires, the game is assumed to be over. The period may be set depending on the kinds of game, and is, for instance, about 30 seconds.

Figure 10:
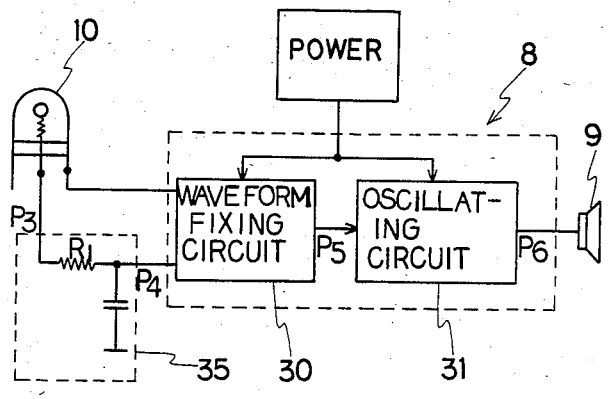
FIG. 10 shows a circuit diagram of the other embodiment used in the present invention.
Figure 11:
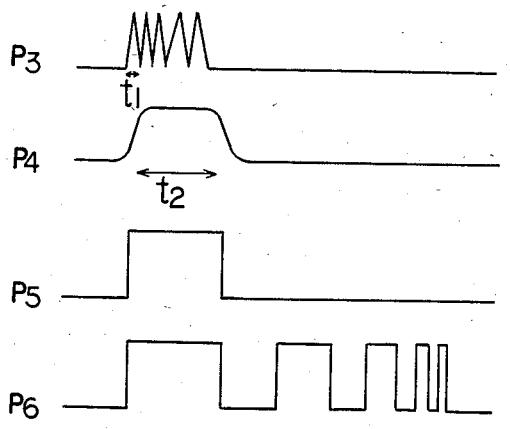
FIG. 11 shows a signal waveform chart obtained in the embodiment according to FIG. 10.

FIG. 10 shows another circuit diagram of the impact sensor 10 and its peripheral circuit. The impact pulse P3 is generated by the impact sensor 10 when an external force is applied to the ball. The pulse P3 is applied to the waveform fixing circuit 30 which is driven by the battery power supply 12. The waveform fixing circuit 30 produces an impact pulse P5. The waveforms of the pulses P3 and P5 are shown in FIG. 11.

It is preferable to employ a commercially available integrated circuit (IC) as the waveform fixing circuit 30. In general a chattering omitting circuit is incorporated in such an IC, which omits a pulse of about 1 msec. as an invalid signal. However, as shown in FIG. 11, the detected impact signals are usually obtained in a form of successive short pulses P3 having a duration time t1 of about 1 msec. to several miliseconds, the impact signal P3 is processed as a chattering signal, which causes miss of detection.

For avoiding such miss of detection, an integrating circuit 35 is provided before the waveform fixing circuit 30 as shown in FIG. 10. The integrating circuit 35 comprises a resistor R1 and a capacitor C, a time constant of which is determined according to the following circuits. By using the integrating circuit 35 a signal P4 of a given pulse duration t2, e.g. not less than about 5 msec. can be obtained. Since almost of true chattering signals enter in a single pulse, any signal having a sufficient voltage can not be obtained by the integrating circuit 35, and thus the true chattering signal can never be processed as an effective signal. The integrated signals P4 is fixed by the waveform fixing circuit 30 to give a pulse P5 (FIG. 11). According to the input pulse P5, the oscillating circuit 31 outputs the pulse train P6 in the manner as explained in FIGS. 7 and 8.

Figure 12:
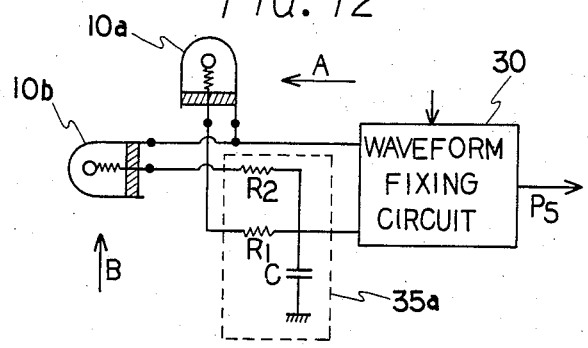
FIG. 12 shows a circuit diagram of impact sensors and their peripheral circuit used in the present invention.

In case of employing two impact sensors 10*a*, 10*b* which are traversely located as shown in FIG. 12, sensibility of the detection can be increased. In such construction, an impact force in the direction of an arrow A can be detected by the sensor 10*a*, while an impact force in the direction of an arrow B can be detected by the sensor 10*b*. An integrating circuit 35*a* is also employed in this embodiment and comprises a resistor R1 for the sensor 10*a*, a resistor R2 for the sensor 10*b* and a capacitor C. Examples of the concrete values of the resistors and the capacitor are, for instance, about 10KΩ and 0.002 μF, respectively. Since the weights and volumes of the resistors and the capacitor are very small, the increases in weight and space of the circuit unit 3 may be negligible.

Figure 13:
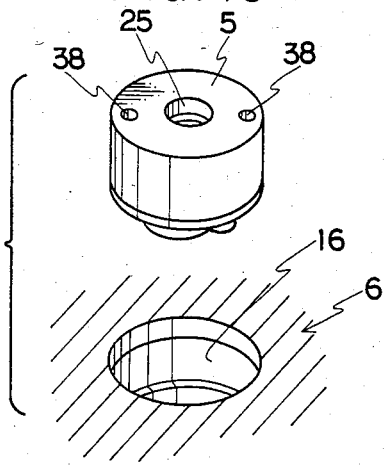
FIG. 13 shows a perspective view of an embodiment of the present invention before the circuit unit is fixed.
Figure 14:
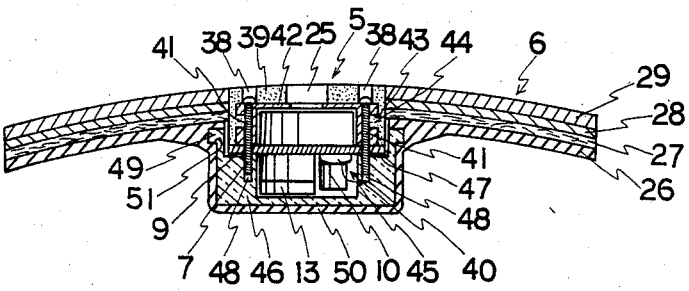
FIG. 14 shows a sectional view of the embodiment shown in FIG. 13.

An embodiment of the present invention in which a fixing member is provided with the cover is shown in FIGS. 13 and 14. The cover 5 has the sound emitting bore 25 and bores 38 for screws 41. The cover 5 comprises an elastic portion 39 and a rigid portion 42. The elastic portion 39 is provided in the outer surface area and is made of a soft rubber or a soft plastic material. The rigid portion 42 is provided in the inner surface area with which a sound emitting circuit unit 40 is in contact and in protions where the screws 41 are secured, and is made of a rigid rubber or a rigid plastic material. The inner surface of the cover 5 defines a space in which the piezoelectric speaker 9 is accommodated. The rigid portion 42 has a groove 43 which is fitted with a projection 44 provided with the soft portion 39. The cover 5 is assembled by applying an adhesive to at least one contact surface of the soft portion 39 and the rigid portion 42, which are separately manufactured, pushing the rigid portion 42 into the soft portion 39, fitting the groove 43 with the projection 44, and then adhering the both portions.

The sound emitting circuit unit 40 comprises the boad 7, the piezoelectric speaker 9, the impact sensor 10, the sound signal generating IC 45 and the battery case 13 in which a battery is housed. The circuit unit 40 is fixed, at the boad 7, to a housing case 46 made of plastics or a light metal with the screws 41. At the same time of the fixing, the cover 5 is fixed to the boad 7 in the rigid portion 42. The housing case 46 has a terrace 47 in a centre area thereof. The width of the area of the terrace 47 where bores 48 for the screws 41 are provided is larger than the other areas. The hight of the terrace 47 is designed so that, when the cover 5 is fixed, the outer surface of the cover 5 is coincident with the surface of the ball. The structure of the body 6 of the ball 1 is the same as that in FIG. 2. In this embodiment the housing case 46 has a flange 49 which is fitted with a groove 51 provide with a housing 50 which is integrally formed with the bladder 26. The flange 49 and the groove 51 serve to prevent the housing case 46 from removal.

Figure 15:
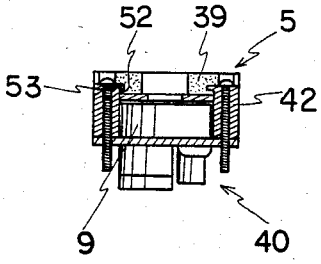
FIG. 15 shows a sectional view of a circuit unit used in the present invention.

A modified embodiment of the above-mentioned embodiment is shown in FIG. 15. In this embodiment a groove 52 is provided with the rigid portion 42 above the piezoelectric speaker 9, and is fitted with a projection 53 provided with the soft portion 39. According to such a structure, the diameters of the cover 5 and the circuit unit 40 can be made smaller. Both portions may be adhered or fused together. In case of fusing, it is preferable that the materials of both portions be similar in their solubility parameters.

According to this embodiment, the circuit unit and the cover are not removed even if a strong impact force is applied to the ball, because the cover comprises the soft portion and the rigid portion, which ensures a tight connection.

As the detecting means for detecting the external impact force applied to the ball, a piezoelectric element can be employed as shown in FIGS. 16 to 22.

Figure 16:
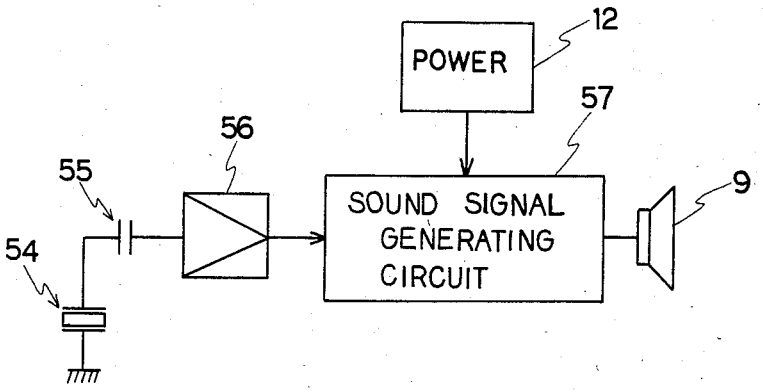
FIG. 16 shows a circuit diagram of an embodiment used in the present invention.

In FIG. 16, a circuit diagram of the embodiment using the piezoelectric element 54 as an impact sensor. One terminal of the piezoelectric element 54 is connected to ground and the other terminal is connected to an amplifier 56 through a capacitor 55. The amplifier 56 can be composed of one transistor. The output signal from the amplifier 56 is supplied to a sound signal generating circuit 57 comprising integrated circuits of an integrating circuit, a waveform fixing circuit, a step-up circuit, an oscillating circuit and/or a melody signal generating circuit. When an extenal force is applied to the ball, an electric signal is generated between the terminals of the piezoelectric element 54. The signal is input to the circuit 57 through the capacitor 55 and the amplifier 56. According to the output signal of the circuit 57, the piezoelectric speaker 9 is drived to emit a buzzer sound or a melody sound.

Figure 17:
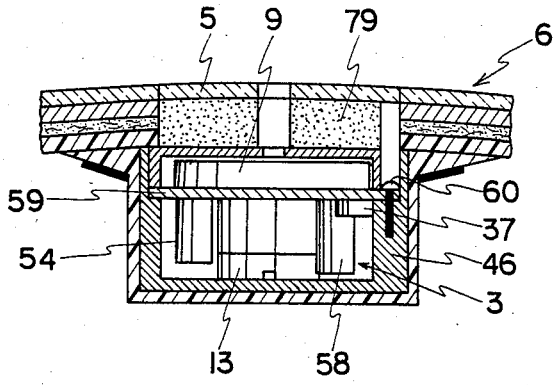
FIG. 17 shows a sectional view of an embodiment of the present invention.
Figure 18:
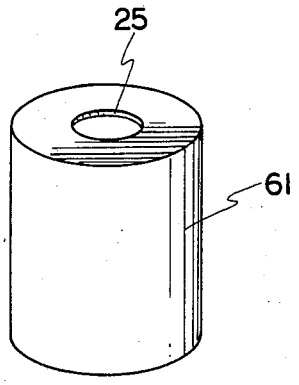
FIG. 18 shows a perspective view of an circuit unit used in the present invention.
Figure 19:
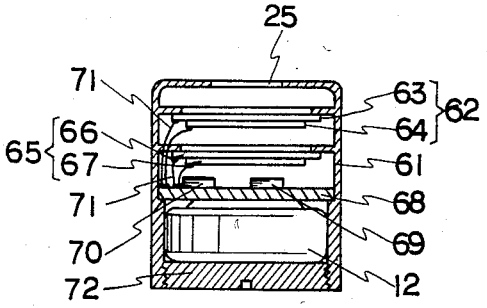
FIG. 19 shows a sectional view of the embodiment shown in FIG. 18.

A preferred mechanical structure of this embodiment is shown in FIG. 17. The circuit unit 3 comprises an integrated circuit portion 37 including the integrating circuit, the waveform fixing circuit and the oscillating circuit or the melody signal generating circuit, the piezoelectric element 54, the battery case 13, a boad 59 which supports the above elements, and the piezoelecric speaker 9. The boad 59 is fixed to the housing case 46 with a screw 60.

Though the piezoelectric element 54 and the piezoelectric speaker 9 are operative on the same theory, the piezoelectric element 54 serves as the impact sensor and the piezoelectric speaker 9 serves as the sound emitting means. The size of the pizoelectric element and speaker can be reduced. For instance, there can be used a commercially available piezoelectric element of about 4 mm in diameter and of about 9 mm in length which is the same or smaller than the above-mentioned mechanical impact sensor 10 (about 5 mm in diameter and abut 10 mm in length).

In case of employing the piezoelectric element as the sensor, an impact resistance of the sensor is particularly improved due to the absence of a movable part. Further, since the sensitivity of the piezoelectric element does not depend on its size, a compact structure can be employed without sacrificing the sensitivity of the sensor. In addition, the piezoelectric element can detect every force which is applied from various directions at a constant sensitivity.

It is also posible to employ a double-stage structure of piezoelectric elements as shown in FIGS. 18 to 22. In this embodiment, there is employed a cylindrical casing 61 made of a rigid resin or a light metal which has the sound emitting bore 25 in its top surface wall. In the casing 61, a first piezoelectric element 62 comprising a vibrating plate 63 made of a stainless steel and a piezoelectric element 64 which is adhered to the plate 63 is accommodated. The first piezoelectric element 62 is located at a position corresponding to the sound emitting bore 25, and serves as the piezoelectric speaker. Under the first piezoelectric element 62, there is provided a second piezoelectric element 65 comprising a vibrating plate 66 and a piezoelectric element 67. The second piezoelectric element 65 serves as the impact sensor. Under the second piezoelectric element 65, there is provided a boad 68 on which an IC chip 69 including the waveform fixing circuit, a timer, the oscillating circuit, and the like and a step-up coil chip 70 are fixed. The first element 62, the second element 65 and the boad 68 are connected through lead wires 71. The battery 12 is arranged bellow the boad 68 and is pushed by a plate 72.

Figure 20:
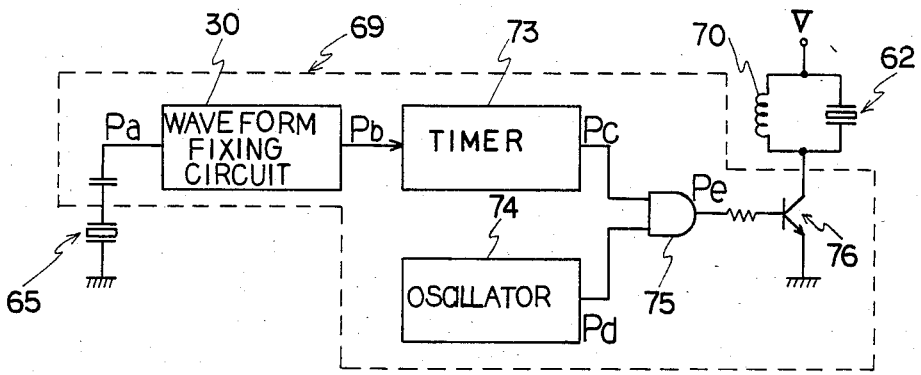
FIG. 20 shows a circuit diagram of an embodiment used in the present invention.
Figure 21:
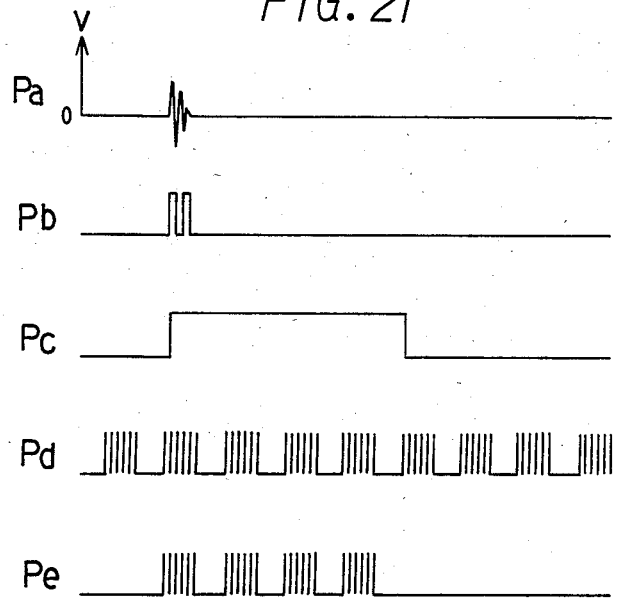
FIG. 21 shows a signal waveform chart obtained in the embodiment according to FIG. 20.

A circuit diagram used in this embodiment is shown in FIG. 20. When an external force applied to the ball is detected by the second piezoelectric element 65, the signal obtained by the element 65 passes through a capacitor to give a signal Pa (shown in FIG. 21). The signal Pa is supplied to the waveform fixing circuit 30 to give a signal Pb which is supplied to a timer 73. The timer 73 outputs a high level signal Pc for a predetermined period of time and an AND gate 75. The AND gate 75 receives an intermittent signal Pd from an oscillator 74 as well as the signal Pc to produce a signal Pe which drives a transistor 76. The collector of the transistor 76 is connected with a paralles circuit of the first piezoelectric element 62 and the step-up coil 70. The emitter of the transistor 76 is connected to ground. The voltage V is a driving voltage from the battery. The signal Pe activates the transistor 76 to drive the piezoelectric speaker 62. The waveforms of the signals Pa, Pb, Pc Pd and Pe are shown in FIG. 21.

The time period of the sound emitting is set by the timer 73 and is, for instance, 1 to several seconds for an infant's ball, and 20 to 30 seconds for a ball of a blind person. The signal Pd may be oscillated at about 3 to 10 Hz, and the frequency in the oscillating duration may be about 2 to 4 KHz. Instead of the timer 73 and the oscillator 74, there can be employed the melody signal generating circuit. In this case, a melody sound is emitted.

Figure 22:
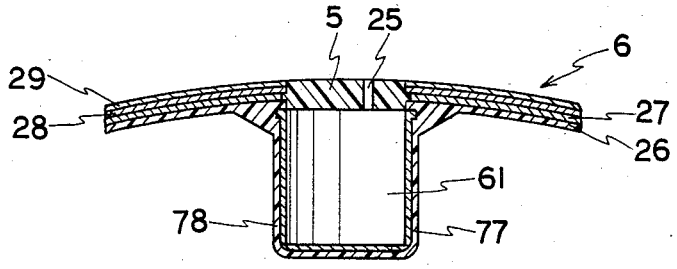
FIG. 22 shows a partially sectional view of the embodiment shown in FIG. 18 which is fixed to the ball.

The cylindrical casing 61 is assembled with a rigid case 77 which is embedded in a housing 78 as shown in FIG. 22. The housing 78 may be integrally molded with the baldder 26.

According to the present invention, all parts for detecting an external force and emitting sound can be made compact and require little electric power demand. Also the weights of the circuit unit and the air injecting valve are well balanced. Therefore, the movement of the ball is not affected by the above attachments.

Further, since the circuit unit is detachable, maintainance, repairing and exchange of a battery can be readily achieved, and, if desired, can be used as an ordinary ball.

In addition, since the sensitivity of the impact sensor can be optionally adjusted, it is possible to emit a predetermined sound corresponding to a particular external force applied to the ball. Therefore, it is possible to give the ball a regular relation between the movement of the ball and the sound to be emitted, which improves a player's interest in games. For instance, a ball which emits a melody sound or a voice sound on kicking is suitable for an infant's ball, and a ball which emits a counting voice sound is suitable for a game in which the number of kicks or dribbles is competed.

What is claimed is:

1. A sound emitting ball, comprising (a) a ball having an airtight bladder for giving impact resilience to the ball in which compressed air is charged through an air injection valve, (b) a concave housing provided within the ball on the opposite portion of the bladder with respect to the valve and contacting the surface of the bladder while keeping the airtightness of the bladder, (c) a cover for concealing an opening in the housing, (d) means for detecting an external force applied to the ball and producing a signal in response thereto, (e) means comprising of an integrated circuit for generating a sound signal according to the signal from the detecting means, (f) means for emitting sound according to the signal from said sound signal generating means, and (g) a battery power source for said above detecting means, sound signal generating means and emitting means, said detecting means, said sound signal generating means, said emitting means and said battery power source being accommodated in the housing, and such that the sum of the weights of the housing, the cover, said detecting means, said sound signal generating means, said emitting means and said battery power source does not substantially interfere with the impact resilience of the ball and is substantially the same as the weight of the valve.

2. The sound emitting ball of claim 1, wherein the detecting means, the sound signal generating means, the sound emitting means and the battery power source are assembled to form a unit, and the unit is accommodated in the housing detachably by means of the cover.

3. The sound emitting ball of claim 2, wherein the cover has a fixing means for fixing the unit to the housing.

4. The sound emitting ball of claim 3, wherein the cover comprises a soft portion and a rigid portion and is fixed in the housing together with the circuit unit by means of the fixing member, said soft portion being provided in the outer suface area and said rigid portion being provided in the inner surface area with which the unit is in contact and in an area where the fixing member is secured.

5. The sound emitting ball of claim 1, wherein the detecting means comprises a integrating circuit for integrating the detected impact signals.

6. The sound emitting ball of claim 1 wherein the detecting means is a mechanical switch comprising a vibrating electrode consisting a spring and a weight electrode which is attached to the free end of the spring, and a fixed electrode which encloses the viblating electrode, said mechanical switch being operative by contacting the vibrating electrode with the fixed electrode when an external impact force is applied to vibrate the vibrating electrode.

7. The sound emitting ball of claim 6, wherein the mechanical switch comprises a member made of an elastic material for restricting the vibration of the vibrating electrode provided at the fixed end of the spring.

8. The sound emitting ball of claim 1, wherein the detecting means comprises a piezoelectric element.

9. The sound emitting ball of claim 1, wherein the sound emitting means comprises a piezoelectric element.

10. The sound emitting ball of claim 1, wherein the detecting means comprises a piezoelectric element and the sound emitting means comprises a piezoelectric element, said two piezoelectric elements being housed in a hollow case in a double-stage structure.

* * * * *